US007189152B1

(12) United States Patent
Ohata

(10) Patent No.: US 7,189,152 B1
(45) Date of Patent: Mar. 13, 2007

(54) HEIGHT ADJUSTMENT SYSTEM FOR ROTATING TOOLS

(75) Inventor: Shinji Ohata, Hiroshima (JP)

(73) Assignee: Nao Enterprise, Inc., Oakland, NJ (US)

( * ) Notice: Subject to any disclaimer, the term of this patent is extended or adjusted under 35 U.S.C. 154(b) by 0 days.

(21) Appl. No.: 11/434,401

(22) Filed: May 15, 2006

(51) Int. Cl.
*B24B 23/00* (2006.01)

(52) U.S. Cl. ..... 451/359; 451/510; 451/521

(58) Field of Classification Search ..... 451/344, 451/359, 360, 363, 504, 508, 510, 521
See application file for complete search history.

(56) References Cited

U.S. PATENT DOCUMENTS 4,655,006 A * 4/1987 Block ..... 451/342
6,116,996 A * 9/2000 Yanase ..... 451/359
6,893,335 B2 * 5/2005 MacKay ..... 451/359

* cited by examiner

*Primary Examiner*—Jacob K. Ackun, Jr.
(74) *Attorney, Agent, or Firm*—Schweitzer Cornman Gross & Bondell LLP

(57) ABSTRACT

A height adjustment mechanism for varying the positioning of a rotating tool on a haft of a machine tool, such as a portable power tool, is in the form of a coupler between the blade and tool arbor. A head of the coupler accepts the tool and connects with a tool drive, the depth of the connection defining the working height or position of the tool. A pair of inter-engaged flanges are mounted upon the shaft of the coupler head, and apply forces to the coupler head and tool drive to maintain the connection depth therebetween and to retain the tool in position. A jam nut further maintains the relative orientation of the flanges.

17 Claims, 3 Drawing Sheets

HEIGHT ADJUSTMENT SYSTEM FOR ROTATING TOOLS

The present invention relates to a new and improved height adjustment system in the form of a coupling for mounting a rotating tool, such as a blade, to the shaft of a machine tool, and particularly to a portable power tool.

BACKGROUND OF THE INVENTION

Blades used in tools such as electric grinders or sanders are utilized in a variety of applications where precise control of the tool may be required. Such applications include shaving mortar or concrete adhering to old bricks, tiles, concrete or frames, and have the objective of removing such foreign matter from the substrate evenly and completely without damaging the substrate. The precise type and size of blade used varies depending upon the circumstances, including the nature of the substrate and its construction, i.e. whether it is a wall, ceiling or floor, as well as the nature of the material to be removed. Thus, the blades may take a variety of diameters and thicknesses and may have various edge treatments and configurations.

Conventional portable power tools to which such blades are affixed have a rotating axle or arbor for mounting the blade. Auxiliary elements, such as a shroud or dust shield, may be part of, or affixed to, the tool for dust collection and to provide protection against inadvertent contact with the rotating tool element. Because the tool arbor is generally of a fixed length, the mounting of a blade thereon may not be optimal with respect to the position of the hood or shroud. Improper alignment between the tool and shroud may compromise tool safety, or may affect the efficient use of the tool. Because the mounting arbor is fixed, and the blade is normally installed fully upon the arbor, the blade periphery may not be properly aligned with the shroud.

It is accordingly the purpose of the present invention to provide a blade mount or coupler which allows a blade of a power tool to be properly positioned with respect to auxiliary equipment associated with the tool, such as a hood or shroud.

A further purpose of the present invention is to provide such a coupling that minimizes the projection of the coupling shaft beyond an adjacent blade portion to minimize interference between the shaft and the work.

Still a further purpose of the present invention is to provide such a coupling which can accommodate a variety of blade sizes and shapes, and can be utilized with a variety of power tool constructions.

BRIEF DESCRIPTION OF THE INVENTION

In accordance with the foregoing and other objects and purposes, a coupler of the present invention comprises a coupling head on which the blade is placed, with a first side of the blade in contact with the head portion of the coupling head. The coupling has a threaded bore that allows it to be mounted upon the tool arbor. A flange with an exterior threaded portion is then positioned on the coupling and in contact with the opposite side of the blade. A second, interiorly-threaded flange is threaded upon the first flange. When the coupling is threaded onto the tool arbor, the second flange is threadably tightened against an arbor flange portion, or an intermediate puck mounted thereon, thus expanding the connection between the first and second flanges and forcing the first flange against the blade, to maintain the blade in position. An intermediate jam nut is also threaded on the first flange, the tightening of which against the second flange locks the second flange in position against the drive, maintaining the orientation of all coupler elements. The blade is thus positioned in a fixed orientation against the coupling head.

With appropriate choices of the lengths of the coupling head and the first and second flanges, proper blade positioning can be accomplished for a variety of blade shapes and locations.

BRIEF DESCRIPTION OF THE DRAWINGS

A fuller understanding of the present invention will be accomplished upon consideration of the following detailed description of a preferred but nonetheless illustrative embodiment thereof, when reviewed in association with the annexed drawings, wherein.

DETAILED DESCRIPTION OF THE INVENTION

Figure 1:
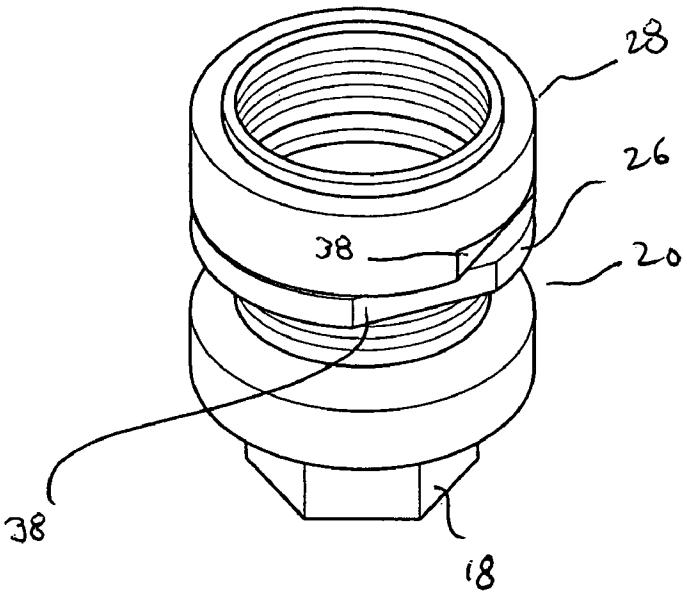
FIG. 1 is a perspective view of a coupler in accordance with the invention.

As depicted in the Figures, a power tool, such as a portable power tool, has an arbor or shaft on which a tool, such as grinder blade 10, is affixed by means of its central mounting bore 12, which may be circular, as shown, or of other shape, such as square. In the present invention the blade is mounted upon coupling head 14 having a hollow shaft 16 which extends through the blade's bore. The blade rests upon the enlarged head 18 of the coupling, which may be in the form of a hexagonal bolt head. The interior surface of the coupling head's shaft 16 is threaded.

First flange element 20 has an exteriorly-threaded, hollow shaft 22, which allows it to be placed upon the shaft of the coupling head 14, the blade 10 being positioned between the head of coupling head 18 and the enlarged head 24 of flange 20. Jam nut 26 is threaded upon the shaft of flange 20, along with second flange element 28 which is generally ring-shaped with internal threading mating with the exterior threading of first flange element 20. An assembly of first and second flanges 20, 28 and jam nut 26, all located on the shaft of coupling head 14, is depicted in FIG. 1. The blade is not shown.

Figure 2B:
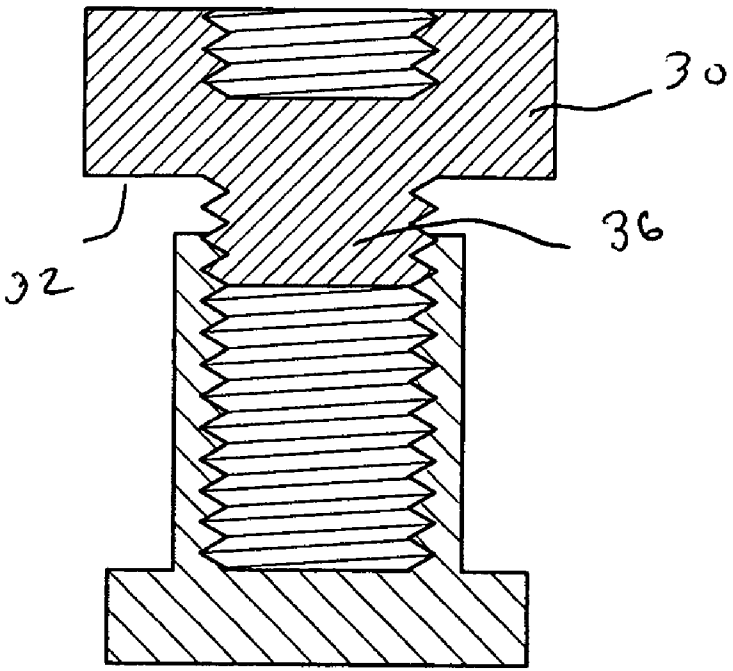
FIG. 2B is a section view of the coupling head and puck.
Figure 2A:
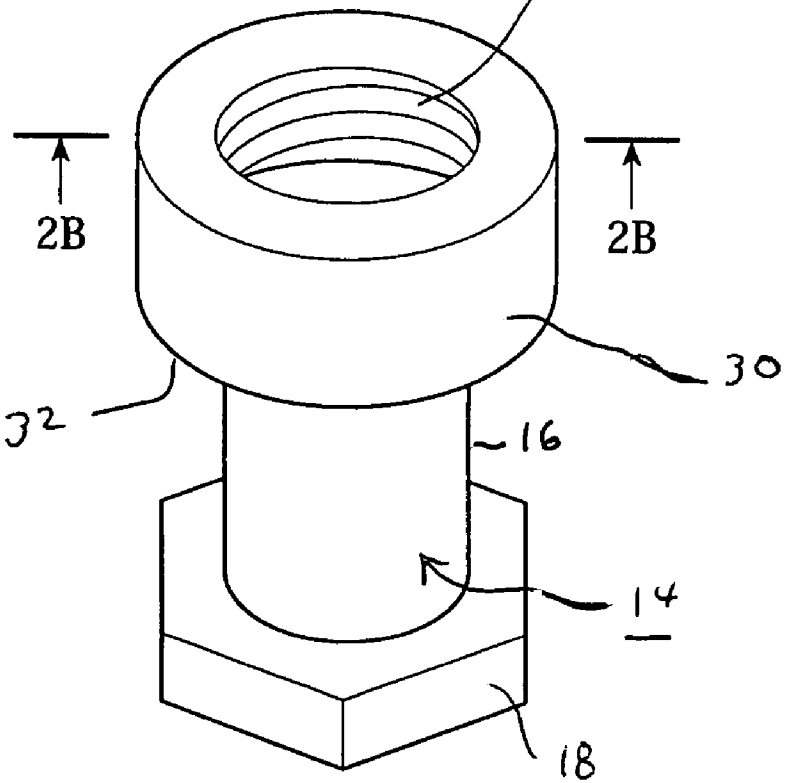
FIG. 2A is a perspective view of the coupling head mounted to a tool arbor puck.

FIGS. 2A and 2B depict the interconnection between the coupling head 14 and a tool drive in the form of a flanged element 30 which in turn may be mounted on a tool arbor, or may be an integral portion of the arbor itself. Element 30 may be, for example, a drive element for an auxiliary device powered by the power tool's motor, such as a blower or dust collection vacuum accessory, or integral with the tool arbor itself. As shown, the drive element may be in the form of a receptacle element having a main portion having a lower surface 32 against which second flange 28 bears, as will be further explained, an internally threaded recess 34 in the top surface of the main portion to engage a complimentary thread on the tool axle, and a correspondingly threaded stud 36 extending from its lower surface.

Figure 4:
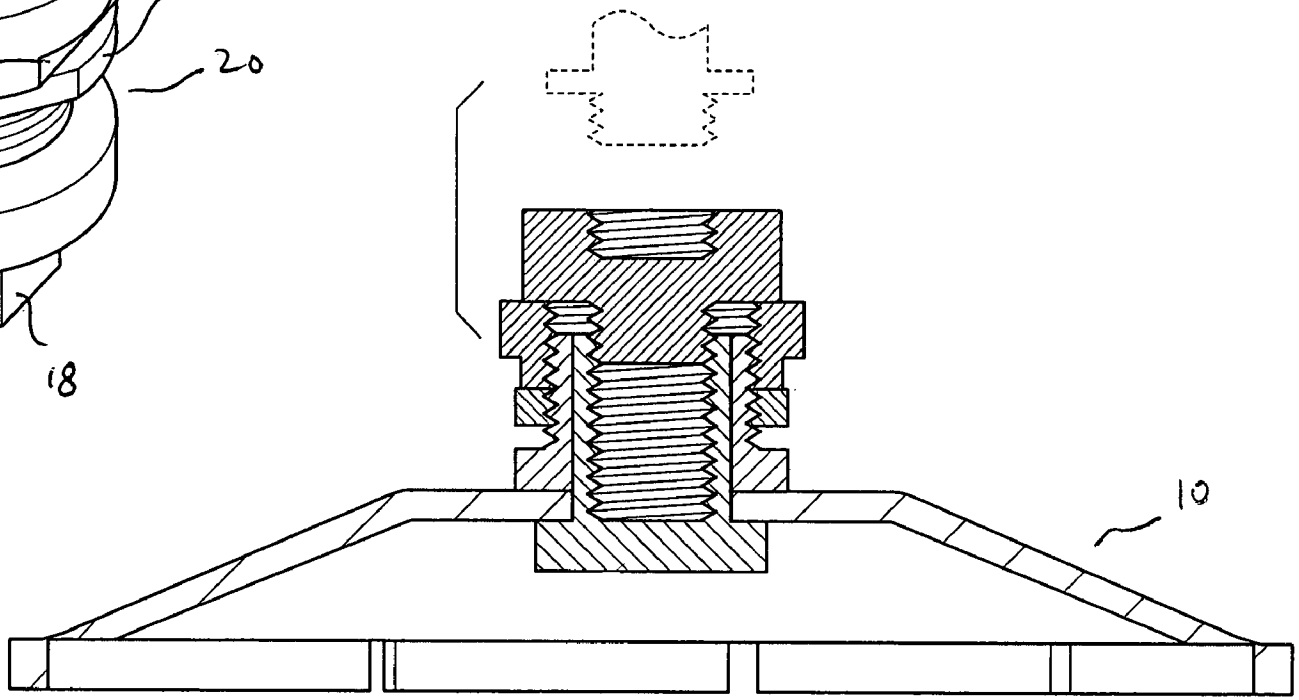
FIG. 4 is a section view of the construction of FIG. 3 in an assembled orientation.
Figure 3:
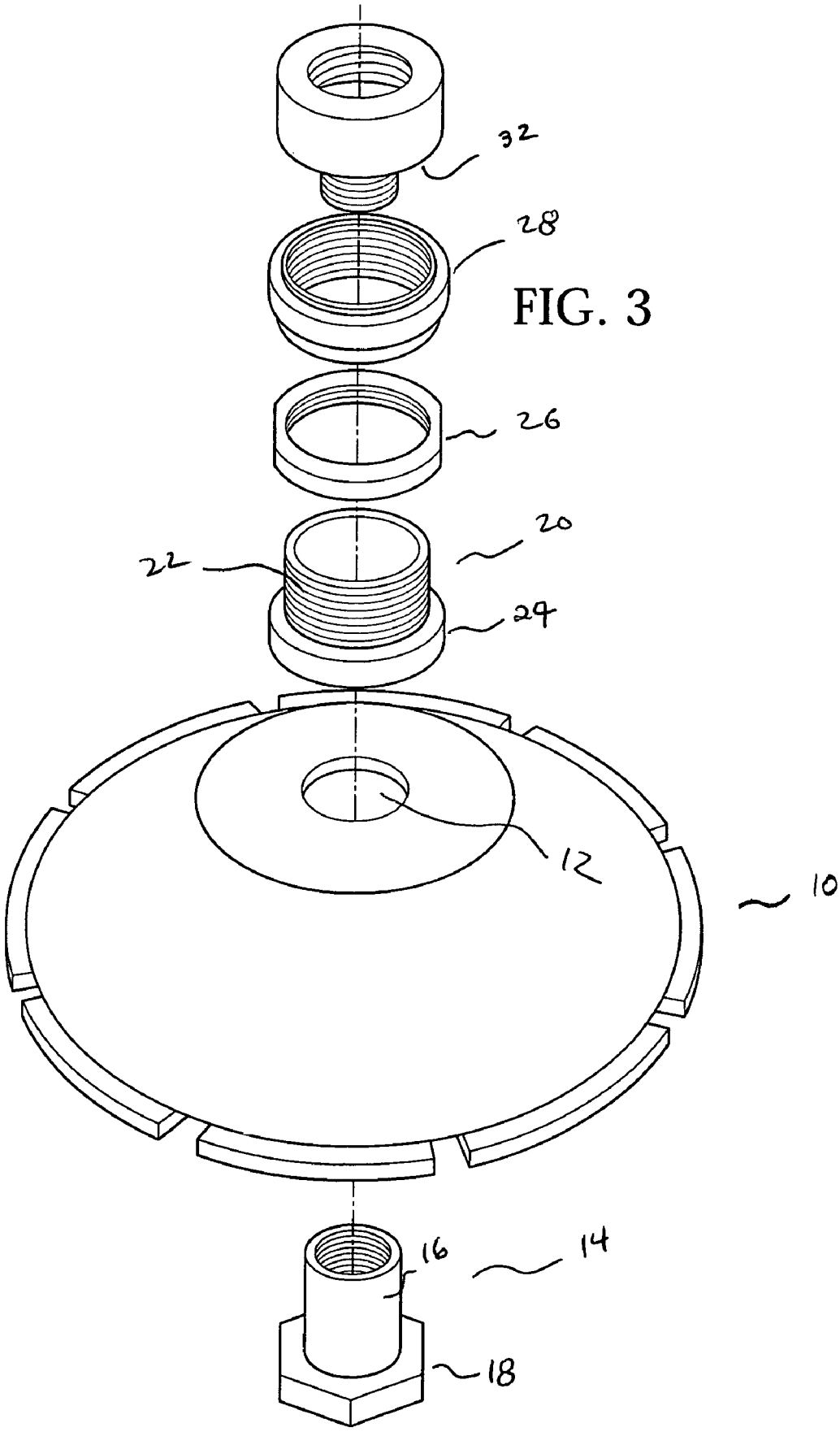
FIG. 3 is an exploded perspective view of the coupler of the invention with a blade mounted thereon.

With reference to FIGS. 3 and 4, the coupling is assembled by first threading the second flange 28 and jam nut 26 upon the first flange 20. The blade 10 and the flange assembly are then mounted upon coupling head 14, the shaft of the head extending upward through the hollow interior of the first flange 20. The stud of receptacle 30 is threaded into the coupling head 14, the depth of the threading into the coupling head establishing the overall length of the assembled coupling unit, and thus the spacing of the blade 10 from the receptacle. With the coupling length established, the second flange 28 is screwed upwardly along the first flange 20 until its upper surface is in contact with the lower surface 32 of the receptacle. With a tight fit the threaded connection between the receptacle and coupling head is fixed in place. The jam nut 26 is then threaded upwardly, against the second flange 28, to further lock the second flange in place against the receptacle. The force of the second flange 28 against the receptacle 30 also urges interconnected first flange 20 against the installed blade, maintaining the blade in position between the first flange 20 and the head 18 of coupling head 14. Because the blade 10 is always urged against the head 18, irrespective of the overall length of the coupling assembly, the only part of the coupling system which extends past the blade, towards an underlying workpiece, is the head of coupling head 18. Thus, vertical positioning of the blade by use of the coupling avoids potential interference between the coupling and the workpiece, and allows the vertical positioning of the blade with respect to the tool arbor connection to be adjusted as required without interference. The overall length of the assembled coupling can be adjusted to accommodate a variety of blades having various bowl shapes and depths. Both the second flange 28 and jam nut may have tool acceptance means, such as opposed flats 38 to accept a wrench, to allow them to be snugly tightened.

As may be appreciated, the second flange 28 need not bear upon the bottom surface of a receptacle 30. In the case where the motor shaft of the tool has an integral flange, as depicted in phantom in FIG. 4, for example, separate receptacle 30 may be dispensed with, the threaded motor shaft directly engaging the coupling 14, the second flange bearing directly against the motor flange.

I claim:

1. A coupler for mounting a rotating tool having a mounting bore to a tool arbor, comprising:

a coupling head having a shaft and means for supporting a first side of the tool about the shaft at a first end;

a tool drive engagable with a second end of the coupling element;

a first flange mounted upon the coupling head shaft having an end for bearing against a second side of the tool;

a second flange adjustably movable along the first flange and having a surface engagable against a confronting surface of the tool drive; and means positionable along the first flange for maintaining the second flange in a engaged position with the tool drive.

2. The coupler of claim 1, wherein the flange maintaining means is a jam nut threaded upon the first flange.

3. The coupler of claim 2, wherein at least one of the second flange and jam nut have opposed tool-accepting flats.

4. A coupler for mounting a rotating tool having a mounting bore to a tool arbor, comprising:

a coupling head having a shaft and means for supporting a first side of the tool about the shaft at a first end;

a tool drive engagable with a second end of the coupling element; and an adjustable length assembly comprising first and second interengagable flanges and lock means, the assembly being mounted upon the coupling element shaft and having a first end face for contacting a second side of the tool and a second end face for contacting the tool drive.

5. The coupler of claim 4, wherein the coupling head comprises an internally threaded body and a head.

6. The coupler of claim 5, wherein the tool drive comprises a body with an engagement surface for the second end face and a threaded stud to engage the body of the coupling head.

7. The coupler of claim 4, wherein the first and second flanges have mating threaded shafts.

8. The coupler of claim 7, wherein the shaft of the first flange is externally threaded.

9. The coupler of claim 8, wherein the lock means comprises a jam nut threadable upon the first flange.

10. The coupler of claim 4, wherein the tool drive is a portion of the tool arbor.

11. The coupler of claim 4, wherein the tool drive is mountable upon the tool arbor.

12. The coupler of claim 11, wherein the tool drive includes a threaded bore to mate with a threaded end of the tool arbor.

13. The coupler of claim 4, wherein the coupling head and tool drive form a second adjustable length assembly.

14. The coupler of claim 13, wherein the coupling head and tool drive are engageable and length-adjustable by means of complementary threaded coupling means.

15. The coupler of claim 14, wherein the complementary coupling means comprise an internally threaded body of the coupling head and an externally threaded stud of the tool drive.

16. A method for mounting a tool blade on a tool arbor through use of the coupler of claim 1, comprising the steps of:

placing the blade on the coupling head;

mounting the second flange and maintaining means on the first flange to form the adjustable length assembly and placing the assembly upon the coupling head;

engaging the coupling element with the tool drive; and repositioning the second flange upon the first flange in a tightly abutting contact with the tool drive whereby the length of the adjustable length assembly is expanded to maintain the blade in fixed position between conforming faces of the coupling head and first flange.

17. The method of claim 16 further comprising the step of engaging the maintaining means with the second flange to maintain the expanded length of the adjustable length assembly.

* * * * *